US005797483A

United States Patent [19]

Smith et al.

[11] Patent Number: 5,797,483

[45] Date of Patent: Aug. 25, 1998

[54] OPERATING MECHANISM LINKAGE ASSEMBLY FOR HIGH AMPERE-RATED CIRCUIT BREAKERS

[75] Inventors: James I. Smith, Avon; Roger N. Castonguay, Terryville, both of Conn.

[73] Assignee: General Electric Company, New York, N.Y.

[21] Appl. No.: 796,709

[22] Filed: Feb. 6, 1997

[51] Int. Cl.[6] ..... H01H 9/00

[52] U.S. Cl. ..... 200/401

[58] Field of Search ..... 200/401, 337

[56] References Cited

U.S. PATENT DOCUMENTS

| | | | |
|---|---|---|---|
| 3,272,953 | 9/1966 | Tillson | 200/337 X |
| 4,001,742 | 1/1977 | Jencks et al. | 335/173 |
| 4,642,431 | 2/1987 | Tedesco et al. | 200/401 |
| 4,741,002 | 4/1988 | Dougherty | 377/49 |
| 5,424,701 | 6/1995 | Castonguay et al. | 335/172 |

*Primary Examiner*—Renee S. Luebke

*Attorney, Agent, or Firm*—Richard A. Menelly; Carl B. Horton

[57] ABSTRACT

A circuit breaker operating mechanism interacts with the circuit breaker movable contact arm by means of an electrically-insulative linkage. Tolerance adjustments are made within the linkage without requiring an additional electrically-insulative shield.

12 Claims, 3 Drawing Sheets

OPERATING MECHANISM LINKAGE ASSEMBLY FOR HIGH AMPERE-RATED CIRCUIT BREAKERS

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

A description of the interaction of the operating mechanism, cradle, latch and contact arm is found within U.S. Pat. No. 5,424,701 entitled "Operating Mechanism for High Ampere-Rated Circuit Breakers". With the arrangements described within both of the aforementioned U.S. patents, the operating mechanism components must be separated from the circuit breaker arc chute which produces electrically-conductive arcing gases upon separation of the circuit breaker contacts upon overcurrent conditions. Oversurface clearance is provided by means of the electrically non-conductive components within the circuit breaker interior. Direct electrical transport between the operating mechanisms components is currently attained by separating the components by a distance sufficient to prevent contact between the components and the ionized arcing gases and by inserting a separate insulative shield. When the circuit breaker operating mechanism components are assembled and adjusted for manufacturing tolerance compensation, the insulative shield is removed and later reassembled, at added assembly cost. It would be economically advantageous to decrease the overall dimensions of the circuit breaker operating mechanism as well as the distance between the operating mechanism and the arc chute without incurring electrical transport between the components and the electrically-active arcing gases without requiring the imposition of a separate insulative shield.

One purpose of the invention, accordingly, is to provide a circuit breaker operating mechanism of reduced dimensions that is capable of interrupting circuit current upon overcurrent conditions without incurring electrical transport between the operating mechanism components and the associated arc discharge gases.

SUMMARY OF THE INVENTION

A circuit breaker operating mechanism interacts with the circuit breaker movable contact arm by means of an electrically-insulative linkage arrangement. Tolerance adjustments are made within the linkage arrangement without requiring any additional electrically-insulative shield. The metal clevis that attaches with the moveable contact arm is covered by an electrically-insulative sleeve. An electrically-insulative toroid within the linkage electrically insulates the operating mechanism link connector.

DESCRIPTION OP THE PREFERRED EMBODIMENT

Figure 1:
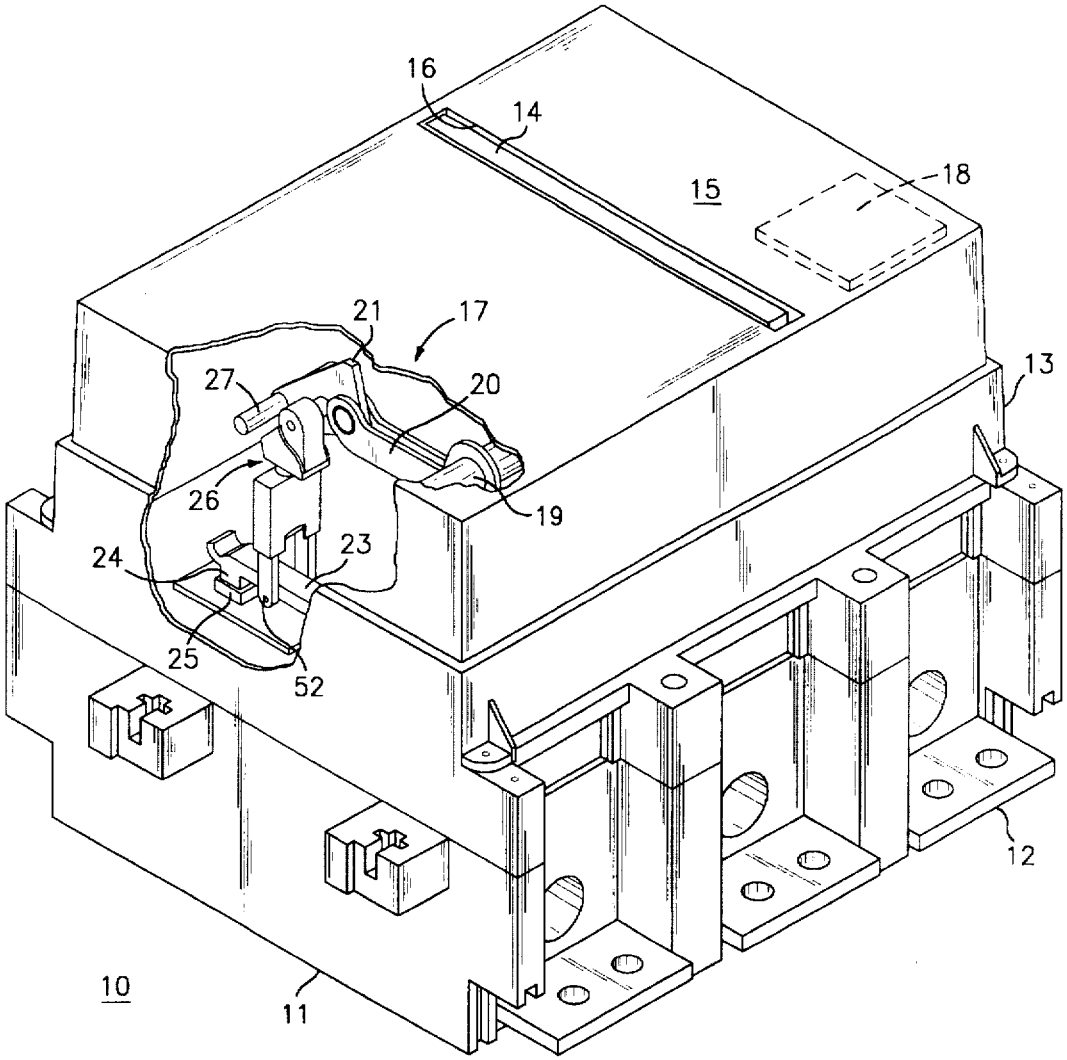
FIG. 1 is a top perspective view of a circuit breaker employing the electrically-insulative linkage arrangement according to the invention.
Figure 2:
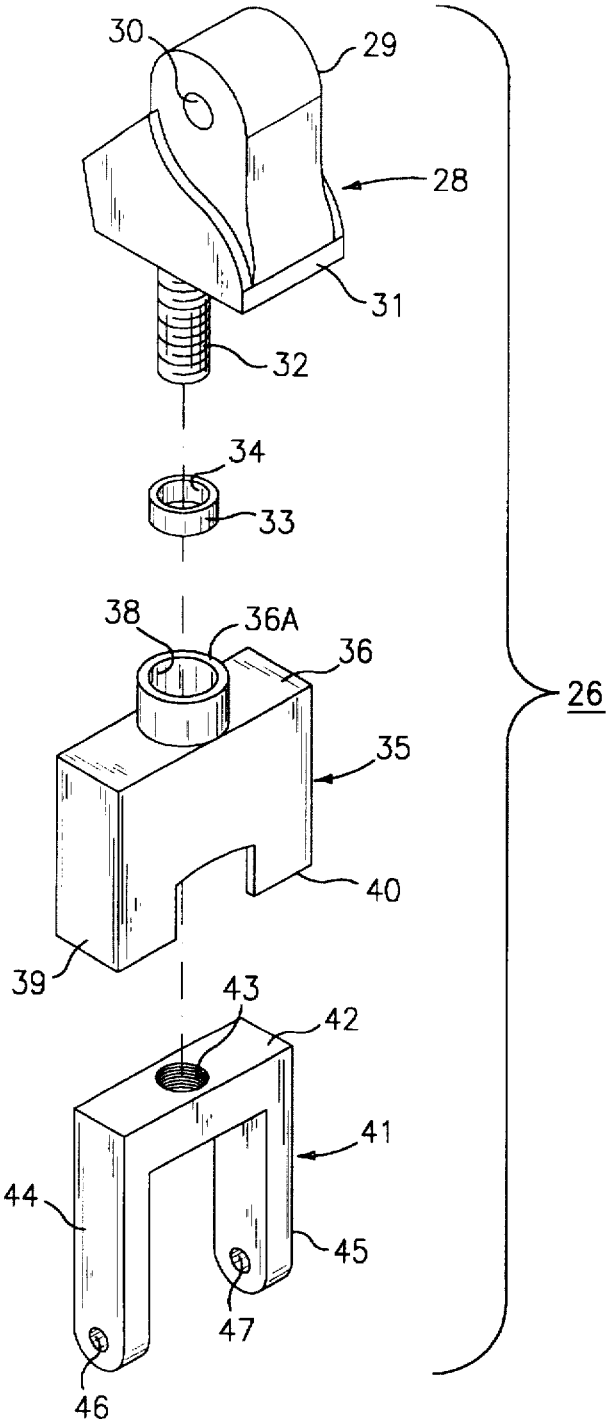
FIG. 2 is a top perspective view of the electrically-insulative linkage arrangement of FIG. 1 with the components in isometric projection.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 13 of similar insulative material is attached prior to attaching the top cover 15 also consisting of an electrically-insulative material. Electrical connection with the interior current-carrying components is made by load terminal straps 12 extending from one side of the base and line terminal straps (not shown) extending from the opposite side thereof. The interior components are controlled by an electronic trip unit 18 contained within the top cover 15. Although not shown herein, the trip unit is similar to that described within U.S. Pat. No. 4,741,002 entitled "RMS Calculation Circuit" to provide a range of protection and control functions. The operating handle 14 arranged within the handle slot 16 allows manual operation of the circuit breaker operating mechanism 17 to separate the circuit breaker movable and fixed contacts 24, 25. As described within the aforementioned U.S. Pat. No. 5,424,701, the drive shaft 19 connects with the opening link 20 by means of the crank 21. In accordance with the invention, a contact carrier drive linkage 26, hereinafter "linkage", connects with the crank 21 by means of a pivot pin 27 with the movable contact arm 23 via the pivot pin 52. The contacts and other current-carrying components are contained within the circuit breaker base 11 and are insulated from the operating mechanism components within the top cover 15. Electrical isolation between the operating mechanism 17 and the movable contact arm 23 is assured by the arrangement of the components contained within the linkage 26 best seen by now referring to FIG. 2.

The link connector 28 is formed from an electrically insulative plastic material such as a high temperature resistant glass-filled polyester, and is shaped to include a perimetric rim or skirt 31 for additional electrical insulation to the threaded steel shank 32 extending from the bottom. The threaded shank 32 is manually attached within the threaded opening 43 in the steel clevis 41. The opening 30 extends though the top of the link connector 28 for receiving the pivot pin 27 as shown earlier in FIG. 1. The provision of the insulative sleeve 35 over the clevis 41 is an important feature of the invention. The insulative sleeve is made of high temperature resistant material such as nylon. The flat shoulder 36 extends over the shoulder 42 on the clevis while the sidearms 39, 40 of the sleeve cover and protect the sidearms 44, 45 of the clevis. The collar 36A also made of an insulative material extends upwards from the shoulder 36 and receives the insulative toroid 33 having the opening 34. Upon transfer of the threaded shank 32 through the openings 34, 38 and 43, the toroid 33 becomes compressed when the shank is rotated to adjust for tolerances between the crank 21 and the movable contact arm 23 shown earlier in FIG. 1. This prevents the ingress of any ionized gases generated within the circuit breaker arc chute, described earlier, from contacting with the clevis 41 by contact with the threaded shank 32. The insulative properties of the top 29 of the link connector 28 prevents transfer of electric current between the electrically-grounded crank 21 and the threaded shank 32 while the sleeve 35 and toroid 33 serve to prevent electrical contact with the clevis 41 when attached to the movable contact arm 23 by means of the apertures 46, 47.

Figure 3:
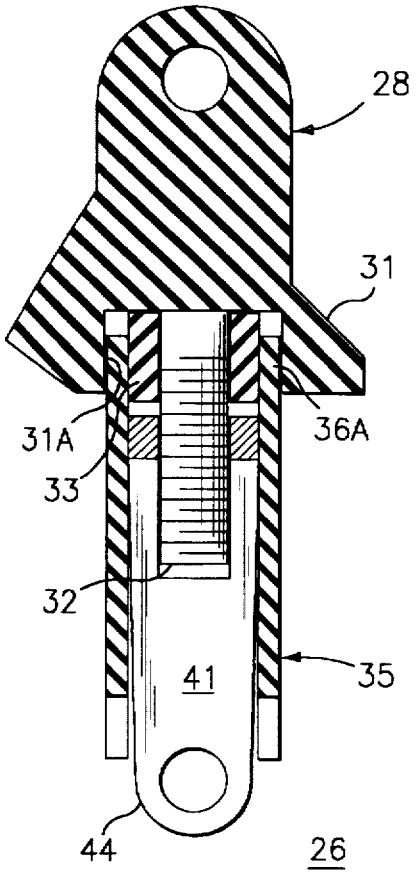
FIG. 3 is an enlarged side sectional view of the electrically-insulative linkage arrangement of FIG. 2.

The electrically-insulative features of the linkage 26 are best seen by now referring to FIG. 3. The link connector 28 is depicted in cross section to show the insulative overhang provided by the skirt 31 to the top of the insulative sleeve 35, the intervening toroid 33, and the threaded shank 32. The provision of the toroid 33 between the top of the clevis 41 as seen from the sidearm 44, insures the protection of the clevis from any mobile ionized gases that may reach the vicinity of the linkage 26 under severe overcurrent conditions.

Figure 4A:
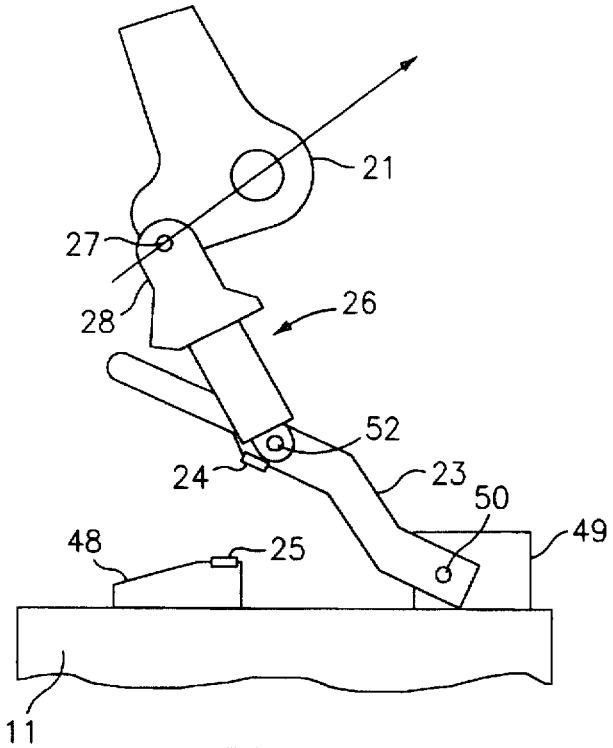
FIG. 4A is a side plan view of a part of the operating mechanism FIG. 1 with the circuit breaker contacts in the OPEN condition.
Figure 4B:
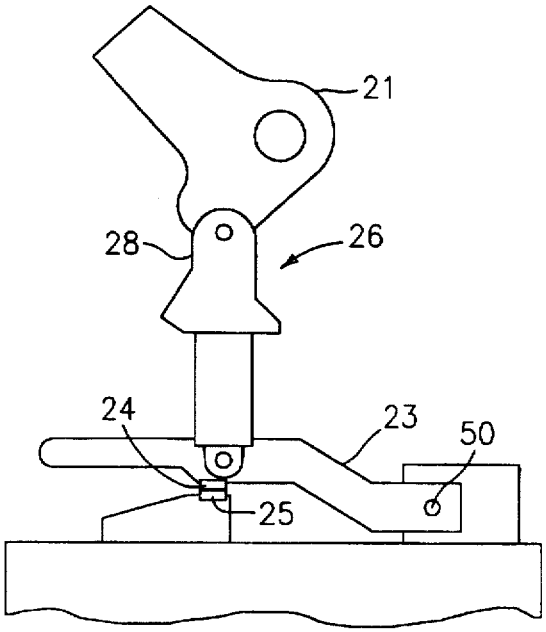
FIG. 4B is a side plan view of the operating mechanism of FIG. 1 with the circuit breaker contacts in the CLOSED condition.

As shown in FIGS. 4A and 4B, the pivot pin 50 that connects the movable contact arm 23 with the contact arm support 49 on the bottom of the base 11, aligns with the pivot pin 52 that connects the movable contact arm 23 with the linkage 26, and also aligns with the pivot pin 27 that connects the linkage with the crank 21. This arrangement of the in-line pivots when the movable contact arm 23 has separated the movable contact 24 on the contact arm from the fixed contact on the contact support 48 moves the forces generated upon the linkage 26 through the center of the pivot pin 27 as indicated by the directional arrow. In view of the excellent resistance of the selected plastic material to compressive forces, the force generated between the movable contact arm 23 and the plastic link connector 28 through the center of pin 27 deters any rotation of the link connector 28 to thereby protect the sleeve 32 (as shown in FIG. 3) from bending forces, which is an important feature of the invention. Referring again to FIG. 3, it is noted that the collar 36A on the insulative sleeve 35 extends upward within the recess 31A formed within the link connector 28. This insures that the shank 32 is completely insulated from any ionized gases that are generated during severe short circuit overcurrent conditions.

A circuit breaker operating mechanism connection with the circuit breaker contact arm has been disclosed having high current-handling capacity without subjecting the operating mechanism and contact arm to ionized gases during over-current circuit interruption conditions.

We claim:

1. An industrial-rated circuit breaker for high level overcurrent protection comprising:

an insulative base:

a pair of separable contacts within said base, one of said contacts being attached to a movable contact arm; and a contact arm drive link connecting with a contact arm crank and an operating mechanism at one end thereof and with said moveable contact arm whereby said contact arm drive link rotates said contact arm to separate said contacts upon occurrence of an overcurrent condition within a protected circuit, said drive link comprises an electrically-insulative top having a threaded shank extending from a bottom part thereof.

2. The industrial-rated circuit breaker of claim 1 wherein said top further includes an opening extending therethrough for receiving connecting means extending from said crank and further includes a perimetric rim extending between said opening and said threaded shank, said perimetric rim protecting said threaded shank from electrical transport to said threaded shank upon occurrence of said overcurrent condition.

3. The industrial-rated circuit breaker of claim 2 wherein said connecting means comprises a first pivot pin.

4. The industrial-rated circuit breaker of claim 2 wherein said perimetric rim is integrally-formed with said top.

5. The industrial-rated circuit breaker of claim 1 wherein said drive link further includes a U-shaped clevis having an apertured top clevis shoulder for receiving a part of said threaded shank.

6. The industrial-rated circuit breaker of claim 5 including a pair of apertured clevis sidearms extending from said top clevis shoulder, said clevis sidearms arranged for receiving means for connecting with said movable contact arm.

7. The industrial-rated circuit breaker of claim 6 wherein said means for connecting with said movable contact arm comprises a second pivot pin.

8. The industrial-rated circuit breaker of claim 6 wherein said drive link further includes an electrically-insulative sleeve, arranged over said clevis for preventing electrical transport to said clevis upon occurrence of said overcurrent condition.

9. The industrial-rated circuit breaker of claim 8 wherein said sleeve comprises a sleeve shoulder arranged for covering said clevis shoulder and wherein said sleeve further comprises a pair of sleeve sidearms arranged for covering said clevis sidearms.

10. The industrial-rated circuit breaker of claim 9 further including an apertured collar extending from said sleeve shoulder arranged for receiving said threaded shank and an electrically-insulative toroid inserted within said collar for providing additional electrical shielding to said threaded shank.

11. The industrial-rated circuit breaker of claim 10 wherein said insulative top includes an aperture formed on a bottom thereof, said aperture receiving said collar for added electrical insulation to said shank.

12. The industrial-rated circuit breaker of claim 10 wherein said collar is integrally-formed with said sleeve.

* * * * *